US005430256A

United States Patent [19]

Taylor et al.

[11] Patent Number: 5,430,256

[45] Date of Patent: Jul. 4, 1995

[54] INSULATED MULTISTRANDED CONDUCTOR

[76] Inventors: John A. Taylor, 4174 S. Mission Rd., Fallbrook, Calif. 92028; Robert C. Bartlett, 395 Ridge Ave., Winnetka, Ill. 60093

[21] Appl. No.: 127,239

[22] Filed: Sep. 27, 1993

[51] Int. Cl.[6] ..... H01B 5/08

[52] U.S. Cl. ..... 174/128.1; 174/110 FC; 174/128.2

[58] Field of Search ..... 174/128.1, 128.2, 110 FC

[56] References Cited

U.S. PATENT DOCUMENTS 1,691,869 11/1928 Fowle ..... 174/128.1
3,240,570 3/1966 Grimes, Jr. et al. ..... 174/128.1
4,538,023 8/1985 Brisson ..... 174/115
4,546,210 10/1985 Akiba et al. ..... 174/114 R
5,220,133 6/1993 Sutherland et al. ..... 174/120 R
5,326,935 7/1994 Yamaguchi et al. ..... 174/120 R

*Primary Examiner*—Morris H. Nimmo
*Attorney, Agent, or Firm*—Ross, Ross & Flavin

[57] ABSTRACT

A multistranded conductor consists of a central bundle of nine strands of small diameter wire (insulated or non-insulated) in a twisted configuration and a series of six outer bundles each being of similar construction, the six outer bundles being equispaced as to each other and circumscribing around the central bundle and being covered with an outer electrically insulating protective covering.

5 Claims, 1 Drawing Sheet

INSULATED MULTISTRANDED CONDUCTOR

BACKGROUND OF THE INVENTION

1. Field of the Invention

The invention relates to electrical conductors and is directed more specifically to stranded conductors used for the transmission of audio signals including but not limited to musical instruments such as electric guitars whereby the quality of sound reproduced is markedly improved over known prior art systems.

2. Background Information

The transmission of audio, video and data transmission signals with the complexity of their wave forms is influenced by, but not necessarily restricted or limited to, the characteristics delineated as 1. the type of dielectric insulation material employed
2. the wall thickness of the insulation material
3. the size or any combination of sizes of the individual wire strands
4. the geometry of the cross section of a wire bundle
5. the number of twists in a foot of length of any sub-group of twisted wires
6. the wire angle relative to the centerline
7. the type of wire material employed
8. the purity of the wire material
9. the crystaline structure of the wire material
10. the number of twists/per/foot of an entire bundle
11. the relationship of the + or − (send and return) conductors to each other—meaning the distance between each other, and their configuration—meaning whether oriented in parallelism or twisted around each other
12. whether the wires are insulated or not, from each other, including the type of insulation employed
13. the effects of inductance, in light of design and structure
14. the effects of capacitance, in light of design and structure
15. the resistivity
16. the type of cable assembly materials used and the particular construction techniques
17. the effects of phase shift in light of design and structure
18. the effects of acoustic and mechanical resonances in light of design and structure
19. the effect of EMI, RFI, hum, magnetic strand interaction, and electrical strand interaction
20. the protection against aging, i.e. the corrosive effects of atmosphere
21. skin effect 3. Description of the Prior Art In the case of an uninsulated multistranded conductor of the known art, the fact of its uninsulation causes it to behave as though it is a solid conductor of a given overall gauge. For example, 29 strands of #29 AWG are approximately the equal of a single #16 AWG diameter wire with a large conductor. The audio signal is subjected to skin effect resulting in a negative alteration of the audio signal. Furthermore, uninsulated stranded conductors are subject to the effects of the corrosive atmosphere, regardless of its outer jacket and how that jacket is applied. As the wires age, the audio signal deteriorates. As to prior insulated multistranded conductors, same have not appeared as available apparently due to the fact that the stripped wire ends have to be immersed in a 800° F. heated solder pot. Due to variables previously alluded to under Background Information, all prior attempts at making insulated multistranded conductors have met with an inability to transmit low frequency audio signals with greater definition and authority, i.e. less roll off.

SUMMARY OF THE INVENTION

The conductors of the invention envision bundles of wires with design features in materials and construction techniques as taught herein for more accurately transmitting audio signals including high current audio signals than has been heretofore attainable.

One object of the invention is to provide a stranded bundle in which a plurality of wires are twisted around themselves without a "spine" or "core wire", such stranded bundle serving as a central bundle (or technically a core) around which a series of six identical bundles are disposed around the central bundle, circumscribing the central bundle an equispaced arrangement as to each other.

DESCRIPTION OF THE PREFERRED EMBODIMENTS

Figure 1:
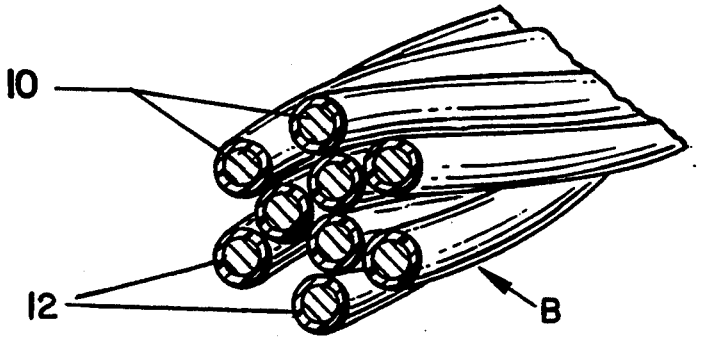
FIG. 1 is a fragmentary perspective view of nine strands of insulated wire bundled in a twisted configuration delineated a "9 strand core bundle"

The conductor as shown in FIG. 1 comprises of plurality (nine in number) of strands of insulated wire 10 bundled in a twisted configuration and delineated a "core bundle B".

Each individual strand is insulated as at 12.

Figure 2:
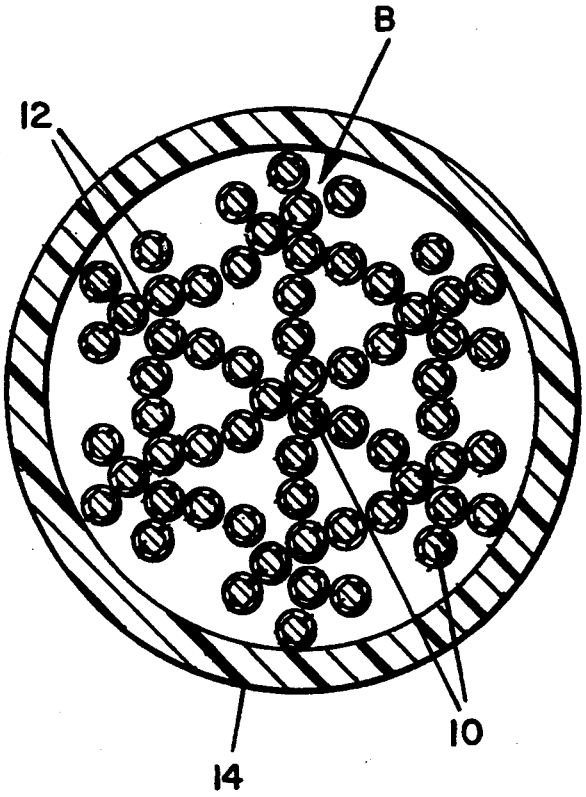
FIG. 2 is a view in cross section of a central "core bundle" circumscribed by an arrangement of six additional equispaced "core bundles" around the outside diameter of the central "core bundle".

Shown in the cross sectional FIG. 2 is a central "core bundle" with six additional "core bundles B" (each of the nine strands, FIG. 1 type), which additional "core bundles" are equispaced in circumscribing manner around the central core bundle, with the seven bundles being enclosed within a fluoropolymer jacket.

The insulation used to coat each wire preferentially may be polyurethane, 810 Nylese, or any high molecular weight fluorocarbon resin, but shall not be limited thereto.

The geometry of nine stranded wires in the makeup of what we have defined as a "core bundle" leads, in combination with other specified features, in a new and innovative approach to the transfer of high current audio signals, especially for audio frequencies below the 1000 Hertz range and extending downwardly even to the 16 Hertz range.

Further as to configuration, we have determined that optimum results are attainable where the seven core bundles of a conductor are geometrically identical, having twelve twists per foot of length, and where the six circumscribing core bundles are wrapped around the central core bundle as a perfect fit.

The finished conductor will thus be observed to be free of any spine or core wire.

The wrap angle of each wire relative to the imaginary bundle centerline shall be less than 30 degrees.

We have observed that such geometrical configuration minimizes acoustical and mechanical resonances while allowing a balanced condition for the electrical transmission of music signals and other complex wave forms.

Preferentially in the resultant conductor comprised of sixty-three strands, the individual wires shall be of #33 AWG, so as to allow what we consider to be the optimum, an overall American Wire Gauge of approximately #15 AWG.

Each strand, sixty-three in total number, will be of a small identical diameter and covered with its own individual insulation.

The overall design is then jacketed with a fluoropolymer dielectric.

With such a structure, a minimization of magnetic strand interaction is achieved as well as a minimization of low frequency phase shifts and a reduction in low level noises.

The ability to transmit music signal pulses and explosive wave fronts with improved accuracy and definition is markedly enhanced.

We claim:

1. An insulated, multistranded conductor comprising:

a central bundle of nine strands of insulated wire in a twisted configuration, a series of six outer bundles each consisting of nine strands of insulated wire in a twisted configuration with the outer bundles being equispaced in a circumscribing manner around the central bundle, and a protective covering of electrically insulating material fitted over the six outer bundles.

2. In the claim 1 conductor, the individual strands being of #33 AWG diameter.

3. In the claim 1 conductor, the strands of a bundle having twelve twists per foot of length.

4. A multistranded conductor comprising:

a central bundle of nine strands of uninsulated wire in a twisted configuration, a series of six outer bundles each consisting of nine strands of uninsulated wire in a twisted configuration with the outer bundles being equispaced in a circumscribing manner around the central bundle, and a protective covering of electrically insulating material fitted over the six outer bundles.

5. In the claim 4 conductor, the individual strands being of #33 AWG diameter.

* * * * *